US005777587A

United States Patent [19]

Tsuru et al.

[11] Patent Number: 5,777,587

[45] Date of Patent: Jul. 7, 1998

[54] SURFACE-MOUNTED ANTENNA

[75] Inventors: Teruhisa Tsuru; Harufumi Mandai; Mitsuhide Kato, all of Nagaokakyo, Japan

[73] Assignee: Murata Mfg. Co., Ltd., Kyoto, Japan

[21] Appl. No.: 664,329

[22] Filed: Jun. 14, 1996

Related U.S. Application Data

[63] Continuation of Ser. No. 319,304, Oct. 6, 1994, abandoned.

[30] Foreign Application Priority Data

Oct. 12, 1993 [JP] Japan ..... 5-254297

[51] Int. Cl.[6] ..... H01Q 1/36

[52] U.S. Cl. ..... 343/752; 343/895

[58] Field of Search ..... 343/752, 789, 343/895, 841, 842, 872, 700 MS

[56] References Cited

U.S. PATENT DOCUMENTS

| | | | |
|---|---|---|---|
| 2,418,084 | 3/1947 | Montgomery | 343/752 |
| 3,568,206 | 3/1971 | Sisson et al. | 343/895 |
| 3,852,756 | 12/1974 | Reese | 343/895 |
| 4,725,845 | 2/1988 | Phillips | 343/702 |
| 4,935,747 | 6/1990 | Yuichi et al. | 343/895 |
| 5,329,287 | 7/1994 | Strickland | 343/752 |
| 5,334,941 | 8/1994 | King | 324/637 |
| 5,530,919 | 6/1996 | Tsuru et al. | 455/90 |

FOREIGN PATENT DOCUMENTS

| | | |
|---|---|---|
| 2237449 | 9/1989 | United Kingdom . |
| 2246910 | 4/1991 | United Kingdom . |

*Primary Examiner*—Donald T. Hajec
*Assistant Examiner*—Tan Ho
*Attorney, Agent, or Firm*—Ostroleuk, Faber, Gerb & Soffen, LLP

[57] ABSTRACT

An antenna includes a dielectric substrate, an input/output electrode, a metal wire, and a metal cap. The metal wire is coiled so that its forward end is connected to the input/output electrode through a connecting electrode and a lead electrode while its another end is connected to an inner surface of a top plate of the metal cap. The metal cap is fixed onto a major surface of the dielectric substrate.

22 Claims, 4 Drawing Sheets

SURFACE-MOUNTED ANTENNA

This is a continuation of application Ser. No. 08/319,304 filed on Oct. 6, 1994 now abandoned.

BACKGROUND OF THE INVENTION

1. Field of the Invention

The present invention relates to the structure of an antenna which is applied to a mobile communication device or the like.

2. Description of the Background Art

FIGS. 8(*a*) and 8(*b*) show a conventional microstrip antenna 15 which is applied, for example, to an on-vehicle mobile communication device or the like. This microstrip antenna 15 has a patch electrode 12 and a ground electrode 13, which are formed on upper and lower surfaces of a dielectric substrate 11 respectively. Further, a connector 14 is mounted on the dielectric substrate 11 on the lower surface provided with the ground electrode 13. The connector 14 has an inner conductor which is connected to a feeding point 12*a* of the patch electrode 12, and an outer conductor which is connected to the ground electrode 13.

The microstrip antenna 15 having the aforementioned structure operates as an antenna, when the patch electrode 12 transmits/receives electric waves.

The microstrip antenna 15 is preferably further miniaturized, due to the requirements of in its application. In the microstrip antenna 15 shown in FIGS. 8(*a*) and 8(*b*), however, the length of the patch electrode 12 serving as a transmission/receiving part must be at least 1/10 the wavelength of the electric waves. Thus, the size of the microstrip antenna 15 is regulated in response to the wavelength of the electric waves, and hence it is difficult to miniaturize the microstrip antenna 15.

The the microstrip antenna 15 is connected to a printed board through the connector 14, and hence it is impossible to directly surface-mount the former on the latter using a simple method. When the connector 14 is removed for surface mounting, it is difficult to match the impedance between the microstrip antenna 15 and a circuit which is connected with the same, and, as a result , reflection loss is increased.

SUMMARY OF THE INVENTION

An object of the present invention is to provide an antenna which can be miniaturized regardless of the wavelength or the frequency of electric waves to be transmitted/received.

Another object of the present invention is to provide an antenna which can be surface-mounted on the surface of a printed board.

An antenna according to a broad aspect of the present invention comprises a dielectric substrate, an input/output electrode which is provided on the dielectric substrate, a coiled metal wire having a first end which is electrically connected with the input/output electrode, and a conductive cap which is connected to a second end of the metal wire.

It is possible to readily miniaturize the metal wire, which is employed for transmission/reception in the antenna, for example, by coiling the same. Consequently, it is possible to miniaturize the overall antenna as compared with a conventional microstrip antenna.

In an antenna according to one aspect of the present invention, the conductive cap is formed of a hollow metal cap having an open end. In more concrete terms, this metal cap has a box-like or cylindrical shape. Thus, it is possible to ensure the desired capabilities without increasing the plane area, thereby contributing to miniaturization of the overall antenna.

In an antenna according to a another aspect of the present invention, the input/output electrode is formed on a side surface of the dielectric and is electrically connected with the first end of the metal wire on a central portion of the dielectric substrate through a lead electrode. Thus, the antenna can be surface-mounted on the surface of a printed board.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
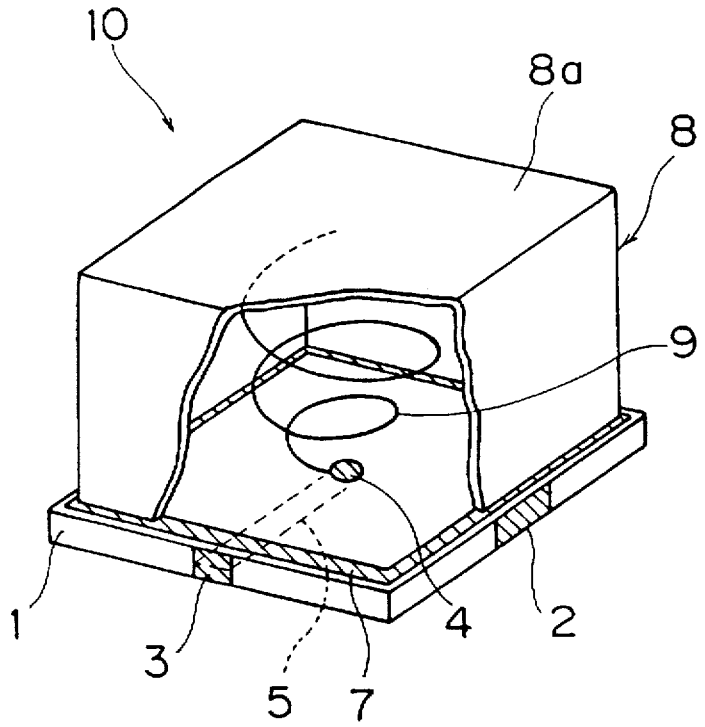
FIG. 1 is a partially fragmented perspective view showing an antenna according to an embodiment of the present invention.
Figure 2:
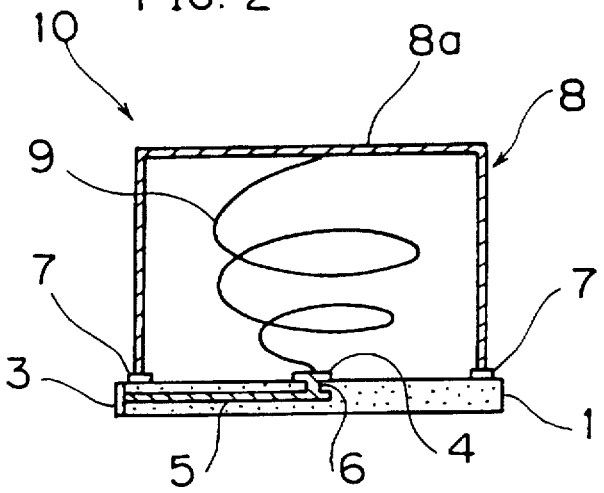
FIG. 2 illustrates the sectional structure of the antenna shown in FIG. 1.

As shown in FIGS. 1 and 2, an antenna 10 according to an embodiment of the present invention comprises a dielectric substrate 1 which is formed of layered ceramics or resins each having a rectangular thin plate shape. Support electrodes 2 (FIG. 1 shows only one electrode) are formed on a pair of side surfaces of the dielectric substrate 1, while an input/output electrode 3 is formed on a side surface which is adjacent to the pair of side surfaces. The support electrodes 2 are employed for mounting the antenna 10 on a surface of a printed board by soldering or the like. When the dielectric substrate 1 of the antenna 10 is directly fixed to the surface of the printed board through an adhesive or the like, the support electrodes 2 are not necessary.

A lead electrode 5 is formed between layers of the dielectric substrate 1. The lead electrode 5 has an end which is connected to the input/output electrode 3, and another end which is connected to a connecting electrode 4 provided on a central portion of the dielectric substrate 1 through a via hole 6.

A first end of a coiled metal wire 9 is connected to the connecting electrode 4, while a second end of the coiled metal wire 9 is connected to an inner surface of a top plate 8*a* of a metal cap 8.

The metal cap 8, which is in the form of a hollow box having an opening in its lower portion, is connected to a fixed electrode 7 which is formed along the peripheral edges of one major surface of the dielectric substrate 1 by soldering the edge of the opening of the metal cap 8 to the fixed electrode 7.

Figure 3:
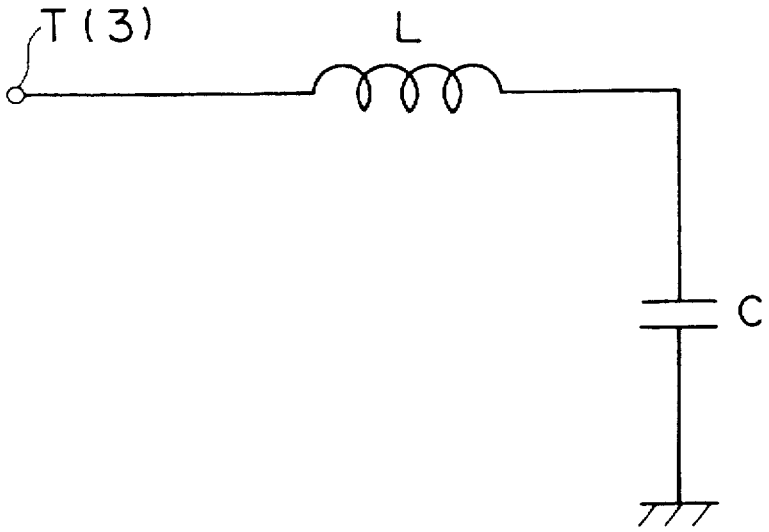
FIG. 3 is an equivalent circuit diagram of the antenna shown in FIG. 1.

FIG. 3 is an equivalent circuit diagram of the aforementioned antenna 10. Referring to FIG. 3, a feeding terminal T corresponds to the input/output electrode 3, while L represents distributed inductance of the coiled metal wire 9 and C represents floating capacitance by the metal cap 8.

This antenna 10 has a resonance frequency $f_0$ which is in the following relation:

$$f_0 = 1/2\pi\sqrt{LC}$$

In order to match impedance between the antenna 10 and a circuit which is connected with the antenna 10, the following relation is taken into consideration with respect to input impedance Z:

$$Z = \sqrt{L/C}$$

Figure 8:
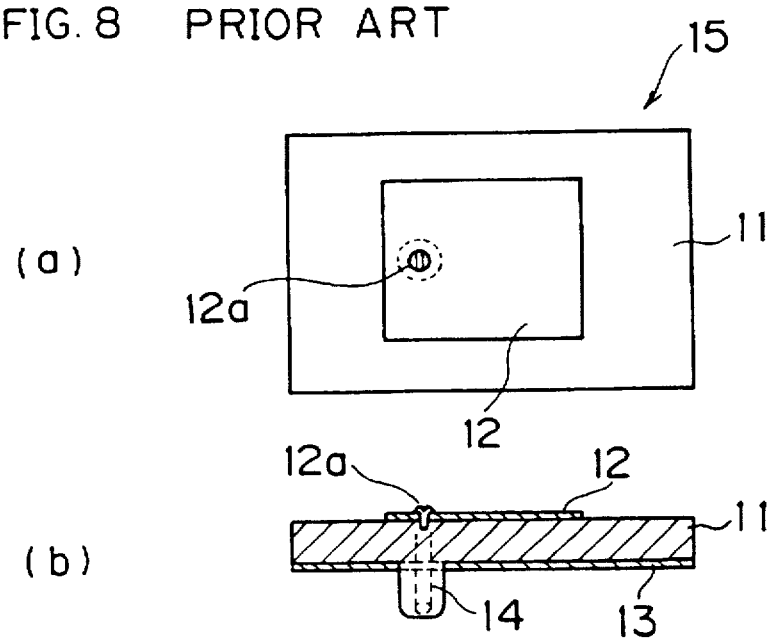
FIG. 8 PRIOR ART
FIGS. 8(*a*) and 8(*b*) are a plan view and a front sectional view respectively showing the structure of a conventional microstrip antenna.

The distributed inductance L of the metal wire 9 and the floating capacitance C by the metal cap 8 are adjusted in accord with the aforementioned two conditions, thereby setting the resonance frequency $f_0$ of the antenna 10. For example, an inversely proportional relation holds between the length of the metal wire 9 and the resonance frequency $f_0$ of the antenna 10 such that the distributed inductance L is increased and the resonance frequency $f_0$ of the antenna 10 is reduced when the length of the metal wire 9 is increased. Conversely, when it is desired that the resonance frequency $f_0$ of the antenna 10 be increased, the length of the metal wire 9 is reduced. In order to reduce the resonance frequency $f_0$, therefore, the length of the metal wire 9 may be increased. In keeping, it is possible to dispose the metal wire 9 in a small space even if it length is increased when the metal wire 9 is freely coiled. Further, the metal cap 8 having a cubic shape can ensure the desired capacity without increasing the required plane area. In comparison with the prior art shown in FIGS. 8(*a*) and 8(*b*), therefore, it is possible to miniaturize the overall antenna 10 as compared with the conventional microstrip antenna 15 even if the metal wire 9 is set at a length exceeding 1/10 the wavelength of the transmitted/received electric waves.

Figure 6:
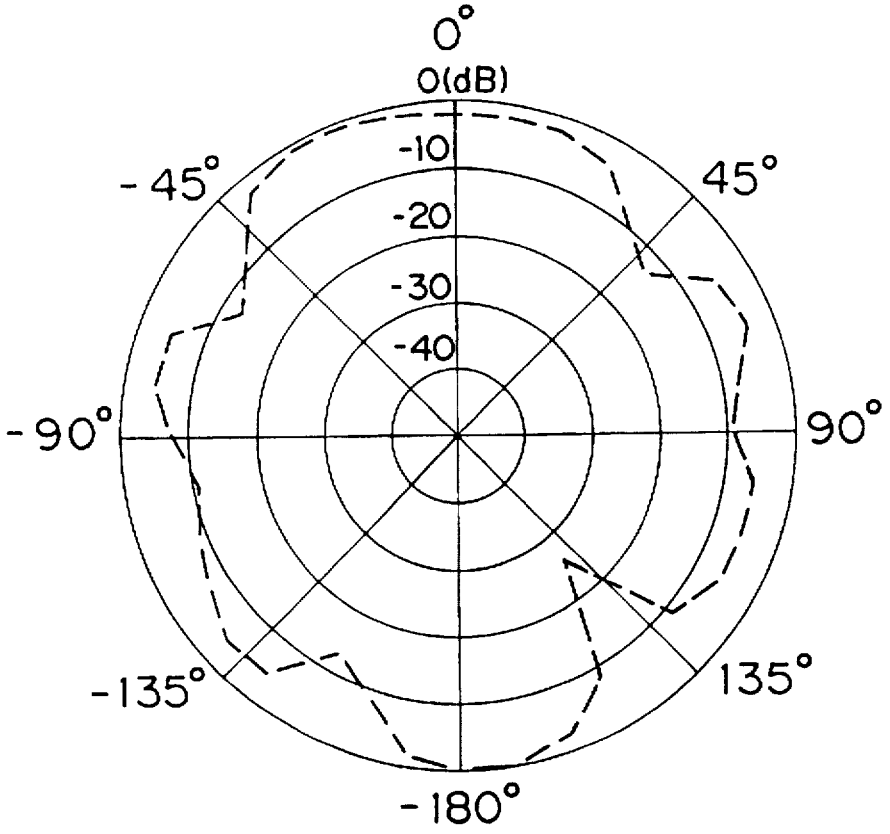
FIG. 6 is a directional pattern diagram of the antenna shown in FIG. 1.
Figure 7:
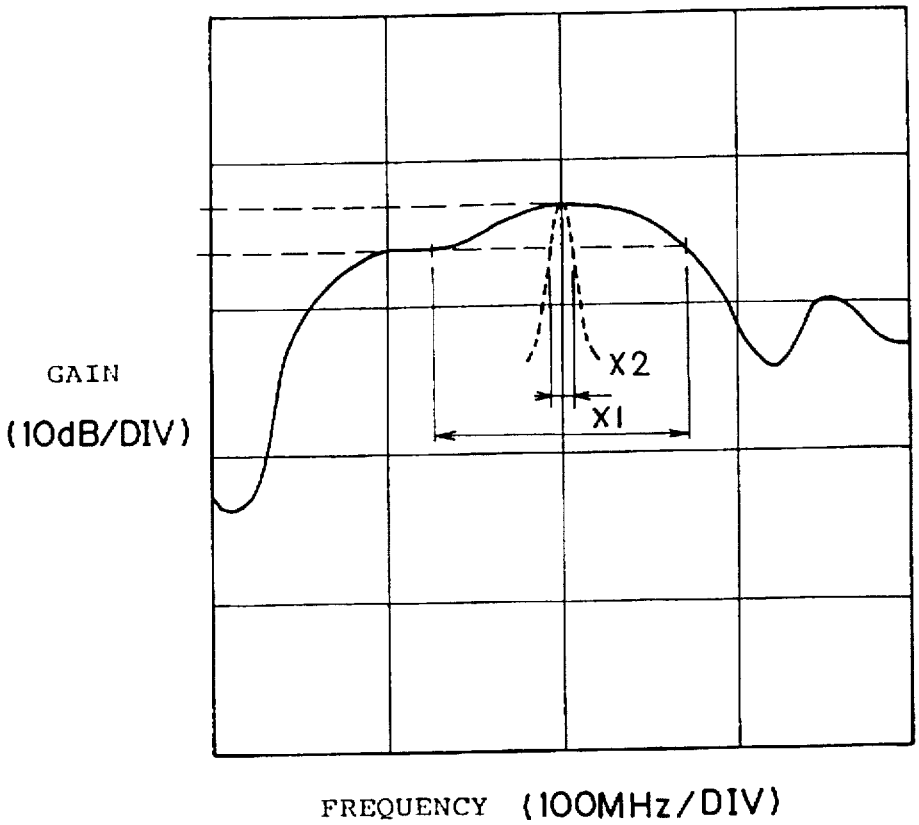
FIG. 7 is a transfer characteristic diagram of the antenna shown in FIG. 1.

Exemplary characteristics of an antenna according to a specific example of the present invention are now described. The antenna according to the specific example comprises a dielectric substrate which is formed using a multilayer ceramic plate of 9 mm in width, 9 mm in depth and 1 mm in thickness, a metal cap which is made of a copper alloy and having a width of 7 mm a depth of 7 mm and a height of 7 mm, and a metal wire which is formed using a copper alloy wire having a diameter of 00.3 mm and having an overall length of 30 mm. FIG. 6 shows the directional pattern of this antenna. As shown in FIG. 6, this antenna has the following antenna characteristics: a maximum gain of −2 dB (dipole antenna ratio), non-directional directivity and a resonance frequency of 1.38 GHz. FIG. 7 shows the transfer characteristics of the antenna. Referring to FIG. 7, broken and solid lines show the characteristics of a conventional microstrip antenna and the antenna according to the specific example of the present invention respectively. Noting a −3 dB band, for example, it is understood that the resonance frequency band of the inventive antenna having a resonance frequency width X1 of 150 MHz is at least about ten times that of the conventional antenna having a width X2 of 12 MHz. Due to this characteristics, it is possible to ensure sufficient gain even if the resonance frequency is displaced or the resonance frequency of mass-produced antenna are dispersed about a set value.

Figure 4:
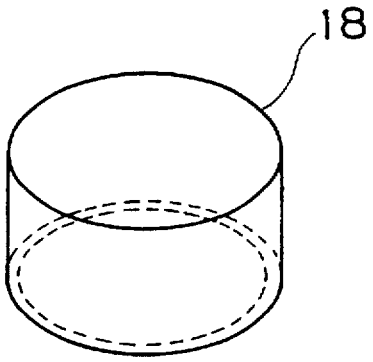
FIG. 4 is a perspective view showing a modification of a metal cap which is employed for the antenna shown in FIG. 1.
Figure 5:
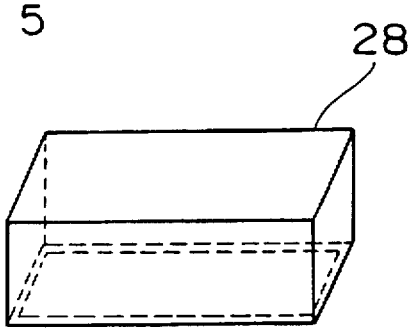
FIG. 5 is a perspective view showing another modification of the metal cap provided in the antenna shown in FIG. 1.

With reference to the antenna 10 shown in FIG. 1, the following modifications are available: the metal cap 8 may be replaced by a cylindrical metal cap 18 shown in FIG. 4, or a metal cap 28, which is in the form of a rectangular parallelopiped, shown in FIG. 5.

The method of fixing the metal cap 8 to the dielectric substrate 1 is not restricted to that of soldering the former to the latter via the fixed electrode 7, but the metal cap 8 may be directly fixed onto the dielectric substrate 1 using an adhesive or the like.

Further, the dielectric substrate 1 is not restricted to the multilayer structure, but may alternatively be formed using a single ceramic sheet or resin sheet. In this case, it is necessary to provide the lead electrode 5 on the major surface of the dielectric substrate 1, while partially notching the fixed electrode 7 and the metal cap 8 for insulating the lead electrode 5 from the fixed electrode 7 or the metal cap 8.

As described hereinabove, the antenna according to the present invention has a transmission/receiving part which is formed by a coiled metal wire, whereby the overall antenna can be miniaturized as compared with a conventional microstrip antenna employing a patch electrode. Further, no connector is employed but an input/output electrode or a fixed electrode is provided on the side surface of the dielectric substrate 1, whereby the antenna can be surface-mounted on a printed board.

Although the present invention has been described and illustrated in detail, it is clearly understood that the same is by way of illustration and example only and is not to be taken as a limitation, the spirit and scope of the present invention being limited only by the terms of the appended claims.

What is claimed is:

1. An antenna comprising:

a dielectric substrate;

an input/output electrode provided on said dielectric substrate;

a coiled metal wire having a first end electrically connected to said input/output electrode;and a conductive cap connected to a second end of said metal wire, said conductive cap being unconnected to a ground potential, the conductive cap enclosing said coiled metal wire.

2. An antenna in accordance with claim 1, wherein said conductive cap has an opening portion being fixed to said dielectric substrate.

3. An antenna in accordance with claim 2, wherein said conductive cap consists of a metal cap having a box shape.

4. An antenna in accordance with claim 3, wherein said opening portion of said conductive cap is fixed onto a major surface of said dielectric substrate, said metal wire being arranged in said conductive cap so that said second end thereof is connected to an inner surface of a top plate of said metal cap.

5. An antenna in accordance with claim 2, wherein said conductive cap consists of a metal cap having a cylindrical shape.

6. An antenna in accordance with claim 5, wherein said opening portion of said conductive cap is fixed onto a major surface of said dielectric substrate, said metal wire being arranged in said conductive cap so that said second end thereof is connected to an inner surface of a top plate of said metal cap.

7. An antenna in accordance with any of claim 2, wherein said opening portion of said conductive cap is fixed onto a major surface of said dielectric substrate, said metal wire being arranged in said conductive cap so that said second end thereof is connected to an inner surface of a top plate of said metal cap.

8. An antenna comprising:

dielectric substrate;

an input/output electrode on said dielectric substrate ;

a coiled metal wire having a first end electrically connected to said input/output electrode;

a conductive cap connected to a second end of said metal wire; and a lead electrode extending from a central portion of said dielectric substrate toward one side surface to be electrically connected to said first end of said metal wire on said central portion of said dielectric substrate while being connected with said input/output electrode on said side surface of said dielectric substrate.

9. An antenna in accordance with claim 8, wherein said dielectric substrate has a multilayer structure of a plurality of dielectric layers, said first end of said metal wire being connected to a connecting electrode being formed on said major surface of said dielectric substrate, said lead electrode being formed between said layers of said dielectric substrate, to be connected with said connecting electrode through a via hole.

10. An antenna in accordance with claim 8, wherein said conductive cap is electrically floating.

11. An antenna comprising:

a dielectric substrate;

an input/output electrode on said dielectric substrate;

a coiled metal wire having a first end electrically connected to said input/output electrode;

a conductive cap connected to a second end of said metal wire and having an opening portion fixed to said dielectric substrate; and a lead electrode extending from a central portion of said dielectric substrate toward one side surface to be electrically connected to said first end of said metal wire on said central portion of said dielectric substrate while being connected with said input/output electrode on said side surface of said dielectric substrate.

12. An antenna in accordance with claim 11, wherein said dielectric substrate has a multilayer structure of a plurality of dielectric layers, said first end of said metal wire being connected to a connecting electrode being formed on said major surface of said dielectric substrate, said lead electrode being formed between said layers of said dielectric substrate, to be connected with said connecting electrode through a via hole.

13. An antenna in accordance with claim 11, wherein said conductive cap is electrically floating.

14. An antenna comprising:

a dielectric substrate;

an input/output electrode on said dielectric substrate;

a coiled metal wire having a first end electrically connected to said input/output electrode;

a conductive metal cap connected to a second end of said metal wire, having an opening portion fixed to said dielectric substrate, and having a box shape; and a lead electrode extending from a central portion of said dielectric substrate toward one side surface to be electrically connected to said first end of said metal wire on said central portion of said dielectric substrate while being connected with said input/output electrode on said side surface of said dielectric substrate.

15. An antenna in accordance with claim 14, wherein said dielectric substrate has a multilayer structure of a plurality of dielectric layers, said first end of said metal wire being connected to a connecting electrode being formed on said major surface of said dielectric substrate, said lead electrode being formed between said layers of said dielectric substrate, to be connected with said connecting electrode through a via hole.

16. An antenna in accordance with claim 14, wherein said conductive cap is electrically floating.

17. An antenna comprising:

a dielectric substrate;

an input/output electrode on said dielectric substrate;

a coiled metal wire having a first end electrically connected to said input/output electrode; and a conductive metal cap connected to a second end of said metal wire, having an opening portion fixed to said dielectric substrate, and having a cylindrical shape; and a lead electrode extending from a central portion of said dielectric substrate toward one side surface to be electrically connected to said first end of said metal wire on said central portion of said dielectric substrate while being connected with said input/output electrode on said side surface of said dielectric substrate.

18. An antenna in accordance with claim 17, wherein said dielectric substrate has a multilayer structure of a plurality of dielectric layers, said first end of said metal wire being connected to a connecting electrode being formed on said major surface of said dielectric substrate, said lead electrode being formed between said layers of said dielectric substrate, to be connected with said connecting electrode through a via hole.

19. An antenna in accordance with claim 17, wherein said conductive cap is electrically floating.

20. An antenna comprising:

a dielectric substrate;

an input/output electrode on said dielectric substrate;

a coiled metal wire having a first end electrically connected to said input/output electrode;

a conductive cap connected to a second end of said metal wire, having an opening portion fixed to a major surface of said dielectric substrate, said metal wire being arranged in said conductive cap with said second end thereof being connected to an inner surface of a top plate of said conductive cap; and a lead electrode extending from a central portion of said dielectric substrate toward one side surface to be electrically connected to said first end of said metal wire on said central portion of said dielectric substrate while being connected with said input/output electrode on said side surface of said dielectric substrate.

21. An antenna in accordance with claim 20, wherein said dielectric substrate has a multilayer structure of a plurality of dielectric layers, said first end of said metal wire being connected to a connecting electrode being formed on said major surface of said dielectric substrate, said lead electrode being formed between said layers of said dielectric substrate, to be connected with said connecting electrode through a via hole.

22. An antenna in accordance with claim 20, wherein said conductive cap is electrically floating.

* * * * *